US008193899B2

(12) United States Patent
Takeuchi et al.

(10) Patent No.: US 8,193,899 B2
(45) Date of Patent: Jun. 5, 2012

(54) CHIP-LIKE ELECTRIC COMPONENT AND METHOD FOR MANUFACTURING THE SAME

(75) Inventors: Katsumi Takeuchi, Toyama (JP); Yutaka Nomura, Toyama (JP); Hiroyuki Kurokawa, Toyama (JP)

(73) Assignee: Hokuriku Electric Industry Co., Ltd., Toyama-shi (JP)

( * ) Notice: Subject to any disclaimer, the term of this patent is extended or adjusted under 35 U.S.C. 154(b) by 59 days.

(21) Appl. No.: 12/995,867

(22) PCT Filed: Jun. 1, 2009

(86) PCT No.: PCT/JP2009/059952

§ 371 (c)(1),
(2), (4) Date: Dec. 2, 2010

(87) PCT Pub. No.: WO2009/148009

PCT Pub. Date: Dec. 10, 2009

(65) Prior Publication Data

US 2011/0080251 A1 Apr. 7, 2011

(30) Foreign Application Priority Data

Jun. 5, 2008 (JP) ..... 2008-148287

(51) Int. Cl.
*H01C 1/034* (2006.01)

(52) U.S. Cl. ..... 338/262; 338/309; 338/328; 338/332; 338/314

(58) Field of Classification Search ..... 338/309, 338/307, 313, 314, 328, 332, 262
See application file for complete search history.

(56) References Cited

U.S. PATENT DOCUMENTS

| | | | | |
|---|---|---|---|---|
| 4,792,781 | A | 12/1988 | Takahashi et al. | |
| 5,815,056 | A * | 9/1998 | Tada et al. | 333/202 |
| 6,023,217 | A * | 2/2000 | Yamada et al. | 338/309 |
| 6,727,798 | B2 * | 4/2004 | Akhtman et al. | 338/309 |
| 7,089,652 | B2 * | 8/2006 | Akhtman et al. | 29/610.1 |
| 7,825,769 | B2 * | 11/2010 | Nomura et al. | 338/309 |
| 2004/0164842 | A1 | 8/2004 | Kuriyama et al. | |

FOREIGN PATENT DOCUMENTS

| | | |
|---|---|---|
| JP | 63-172401 | 7/1988 |
| JP | 63-188903 | 8/1988 |
| JP | 11-307304 | 11/1999 |
| JP | 2000-091101 | 3/2000 |
| JP | 2004-158696 | 6/2004 |
| JP | 2004-259863 | 9/2004 |
| JP | 2004-288806 | 10/2004 |
| JP | 2007-042953 | 2/2007 |
| JP | 2007-189122 | 7/2007 |
| JP | 2008-084905 | 4/2008 |

* cited by examiner

*Primary Examiner* — Kyung Lee
(74) *Attorney, Agent, or Firm* — Rankin, Hill & Clark LLP

(57) ABSTRACT

A chip-like electric component such as a chip resistor is provided, which is easy to manufacture and in which cracks or fractures of an insulating substrate are unlikely to occur. A pair of surface electrodes 21, 23 are formed so that thicknesses of the pair of surface electrodes increase from a resistor layer 13 toward end portions 30 of an insulating substrate 29 in a direction in which the pair of surface electrodes 21, 23 are arranged. A plating reservoir S is formed between one of the surface electrodes 21, 23 and an insulating protective layer 15. When forming at least one plated layer 33, a plated metal pools in the plating reservoir S. The at least one plated layer 33 may work to reduce to some extent a height difference between a soldering electrode portion 21, 23, 27, 33 and the insulating protective layer 15.

13 Claims, 3 Drawing Sheets

CHIP-LIKE ELECTRIC COMPONENT AND METHOD FOR MANUFACTURING THE SAME

TECHNICAL FIELD

The present invention relates to a chip-like electric component and a manufacturing method of the chip-like electric component.

BACKGROUND ART

In a chip resistor, which is a kind of comparatively large chip-like electric component, a resistor body or the like is formed of a thick film. Soldering electrodes are also each formed of a thick film. In some comparatively small resistors, electrodes and resistor bodies are formed, using only a thin-film forming technology. Further, in some comparatively small resistors, soldering electrodes are formed by a combination of a thick film and a thin film.

In a chip resistor manufacturing method described in Japanese Patent Application Publication No. 1988-172401 (JP1988-172401A), an alumina substrate for obtaining a large number of or multiple chip resistors is employed. The alumina substrate is capable of being cut and separated in order to obtain individual chip substrates. First, a plurality of thick-film resistor body layers made of RuO2 are formed on the surface of the alumina substrate in a longitudinal direction at constant intervals, by screen printing or the like. Next, at least one pair of C-letter shaped side electrodes are formed so that the side electrodes continuously cover both end portions of the thick-film resistor body layers, both side surfaces of the alumina substrate, and both end portions of the back surface of the alumina substrate. Thin-film forming techniques such as sputtering and ion plating are used in forming the side surface electrodes. Further, a glass coat is formed to cover the entire surface of each resistor body. The glass coat is formed as a protection film when resistance trimming is performed. After the glass coat has been formed, laser trimming is performed. After the trimming has been finished, a protection coat made of glass or the like is formed on the surface of each glass coat. Then, the alumina substrate is cut into individual chip substrates, thereby completing the manufacture of the chip resistors. According to this related art, the thickness of each electrode may be reduced. Consequently, the size of the chip resistor may be reduced.

Japanese Patent Application No. 11-307304 (JP11-307304A) discloses a structure of a chip resistor and a manufacturing method of the chip resistor. In the chip resistor, a pair of surface electrodes are formed on the surface of a ceramic substrate using a thick film. A base electrode layer is then formed on each surface electrode using a thin-film forming technique such as sputtering. A plated Layer is further formed on the base electrode layer.

DISCLOSURE OF THE INVENTION

Technical Problems

However, the more the size of the component is reduced, a comparatively large height difference is made between a soldering electrode portion and an overcoat even when each of the surface electrodes is formed of the thick film as in the chip resistor or chip-like electric component described in JP11-307304A. Due to the presence of this height difference, the following problem arises. When the component is suctioned by a vacuum suction nozzle, a force applied to the insulating substrate may cause a crack or fracture of the insulating substrate. An additional layer may be formed on the surface electrodes in order to reduce such a height difference. However, when the size of the component is reduced, a problem arises that manufacture of the component becomes difficult and the cost of the component is increased.

An object of the present invention is to provide a chip-like electric component that has solved the above-mentioned problems.

A specific object of the present invention is to provide a chip-like electric component such as a chip resistor which is easy to manufacture and in which cracks or fractures of an insulating substrate have been prevented without increasing the cost.

Solution to Problems

A chip-like electric component targeted by the present invention uses an insulating substrate made of ceramic, including a front surface and a back surface facing the front surface. A pair of surface electrodes based on metal glaze is provided at both end portions of the front surface of the insulating substrate. The pair of surface electrodes based on metal glaze may be formed by printing a paste by screen printing. The paste may be obtained by kneading conductive powder of Ag or the like into glass, for example. The chip-like electric component has an electrical element layer electrically connected to the pair of surface electrodes and formed on the front surface. The electric element layer is a resistor layer when the chip-like electric component is a chip resistor. When the chip-like electric component is an inductor, the electrical element layer is a conductor layer. The chip-like electric component may be a capacitor or the like. The chip-like electric component includes an insulating protective layer made of an electrical insulating material. The insulating protective layer covers entirely the electrical element layer and partly the pair of surface electrodes adjacent to the electrical element layer. The chip-like electric component further includes a thin-film conductive layer for covering at least portions of the pair of surface electrodes that are not covered with the insulating protective layer. The thin-film conductive layer includes at least one plated layer. A soldering electrode portion is formed of each surface electrode and the thin-film conductive layer.

In the present invention, the pair of surface electrodes are formed so that thicknesses of the pair of surface electrodes increase from the electrical element layer toward a pair of end portions of the insulating substrate positioned in a direction in which the pair of surface electrodes are arranged. When the surface electrodes of such a shape are employed, a plating reservoir is formed between each surface electrode and the insulating protective layer. For that reason, a plated metal pools in the plating reservoir when the at least one plated layer is formed. The at least one plated layer may work to reduce to some extent a height difference between the soldering electrode portion and the protective layer. Accordingly, the height difference may be reduced without providing an additional layer for reducing the height difference. The larger the number of layers of the at least one plated layer is, the more the height difference is reduced.

Preferably, the thin-film conductive layer may include a base conductive layer formed by sputtering or evaporation for covering the portions of the surface electrodes that are not covered with the insulating protective layer and the at least one plated layer formed on the base conductive layer. With this arrangement, the at least one plated layer may be formed only on the base conductive layer without fail.

The base conductive layer may include extended conductive portions for covering side surfaces of the end portions of the insulating substrate adjacent to the surface electrodes. In this case, the at least one plated layer includes extended plated portions for covering the extended conductive portions. The extended plated layer portions form side surface electrodes of the insulating substrate. Thus, soldering strength may be increased.

The extended conductive portions may further extend to part of the back surface of the insulating substrate. In this case as well, the extended plated portions further extend to cover the extended conductive portions which extend to part of the back surface. As a result, the extended plated layer portions formed on the back surface of the insulating substrate work as back surface electrodes of the insulating substrate. The soldering strength may be further increased.

Preferably, the base conductive layer may include Cu, Ni, and Cr. Further, preferably, the at least one plated layer may be of a two-layer structure in which an Sn plated layer is formed on a Ni plated layer. With this structure, the base conductive layer and the at least one plated layer may be formed without fail.

When the specific chip resistor is formed of the chip-like electric component of the present invention, the electrical element layer should be formed of the resistor layer. Then, preferably, the insulating protective layer may comprise a glass layer for covering the resistor layer and an insulating resin layer for covering the glass layer. With this arrangement, resistance of the resistor layer may be prevented from varying after the resistor layer has been trimmed may be prevented.

A method of manufacturing a chip-like electric component of the present invention includes the following steps. In a first step, a plurality of electrode layers are formed on a front surface of a large-sized insulating substrate made of ceramic at predetermined intervals by screen printing, using a conductive paste based on metal glaze, to constitute columns of electrode layers and rows of electrode layers. In a next step, an electrical element layer is formed on the front surface of the large-sized insulating substrate by printing so that the electrical element layer extends across adjacent electrode layers included in the rows of electrode layers. In a next step, an insulating protective layer is formed by printing using an electrical insulating material so that the insulating protective layer covers entirely the electrical element layer and partly the pairs of electrode layers adjacent to the electrical element layer. In a next step, a plurality of slits are formed in the large-sized insulating substrate so as to halve each of the electrode layers included in the columns of electrode layers at a central portion of each electrode layer and then form a pair of surface electrodes at both end portions of the electrical element layer. In a next step, a base conductive layer is formed, by sputtering or evaporation, for covering portions of the pair of surface electrodes that are not covered with the insulating protective layer and inner surfaces of the slits. Then, in a next step, chip pieces each including the pair of surface electrodes, the electrical element layer, and the insulating protective layer are separated after the conductive layer has been formed. In a final step, at least one plated layer is formed on the base conductive layer of each of the separated chip pieces. Each electrode layer is formed by screen printing in a doomed shape in which the height of the central portion thereof is the highest, or a shape that is smoothly convex in a direction away from the front surface of the insulating substrate. When such a method of halving the electrode layer at the central portion of the electrode layer is employed, each of the pair of surface electrodes may be readily shaped to have a thickness that increases toward the end portions of the insulating substrate.

BEST MODE FOR CARRYING OUT THE INVENTION

Figure 1:
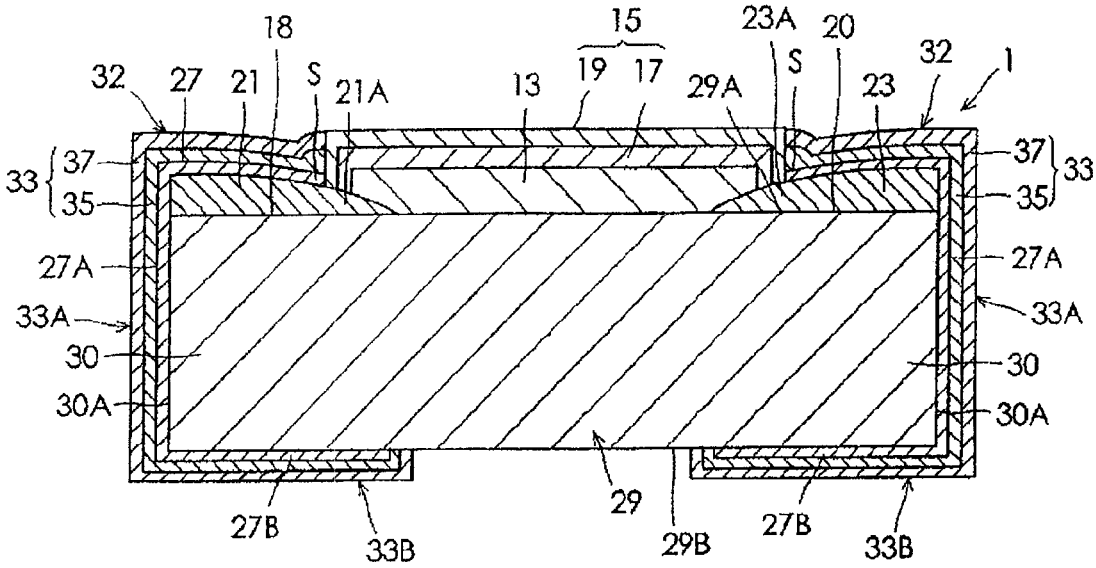
FIG. 1 is a sectional view schematically showing a structure of a chip resistor, which is a kind of chip-like electric component and has been manufactured by a method of manufacturing a chip-like electric component according to the present invention.
Figure 2:
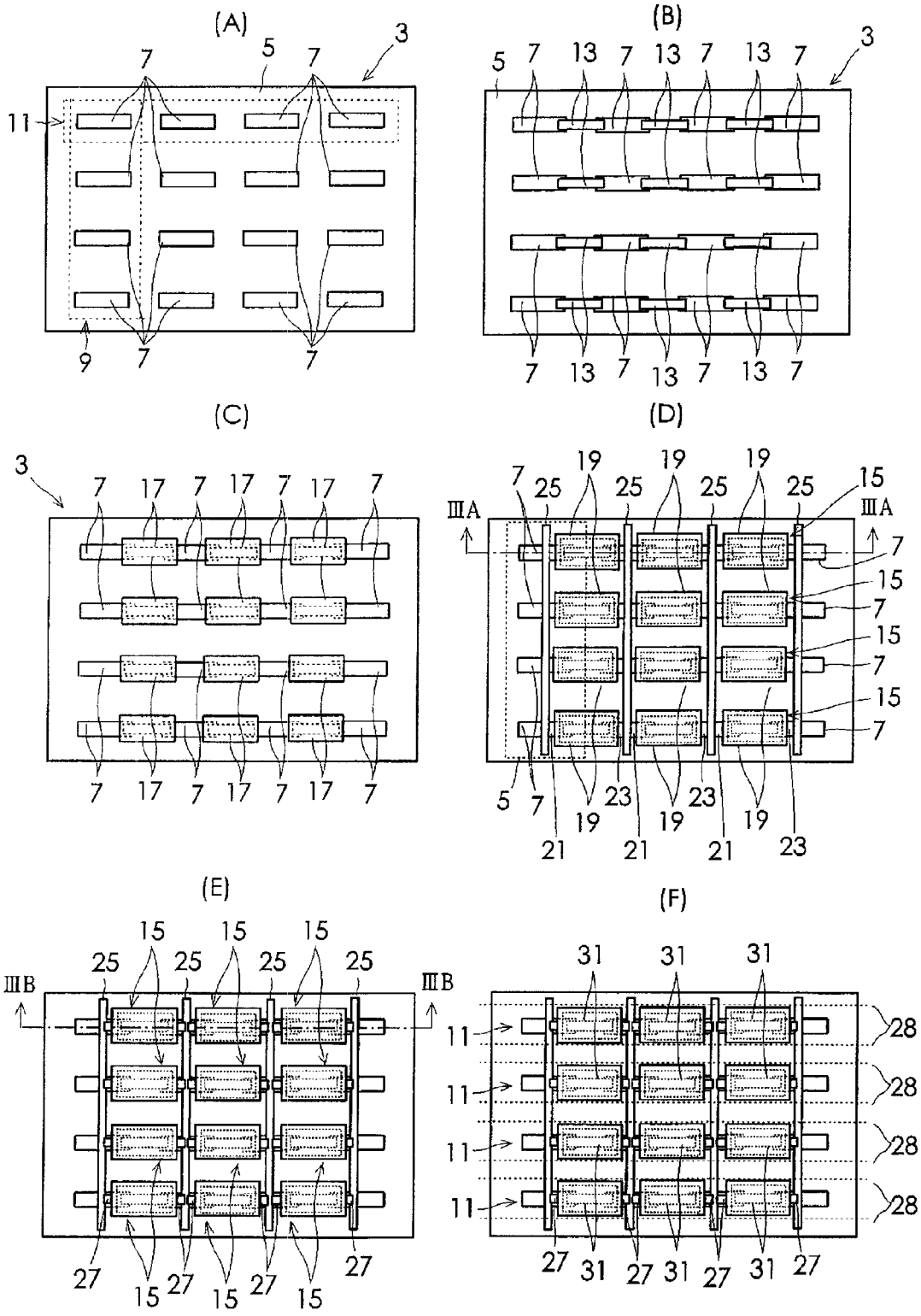
FIGS. 2(A) to 2(F) are step diagrams showing a plurality of steps in the manufacturing method of the chip resistor in au embodiment of FIG. 1.

A chip-like electric component according to an embodiment of the present invention will be described below in detail with reference to drawings. FIG. 1 is a sectional view schematically showing a structure of a chip resistor 1, which is a kind of chip-like electric component manufactured by a method of manufacturing a chip-like electric component according to the present invention. FIG. 1 is the sectional view schematically showing the structure of the chip resistor 1 in order to facilitate understanding. The dimension, thickness, and shape of each component are not to scale or not proportional to those of an actual component. FIGS. 2(A) to 2(F) are step diagrams showing a plurality of steps in the manufacturing method of the chip resistor 1 in the embodiment in FIG. 1. While describing the manufacturing method of the chip resistor 1 in this embodiment, the structure of the chip resistor 1 in FIG. 1 will also be described in conjunction with the manufacturing method, using the step diagrams in FIG. 2.

Figure 4:
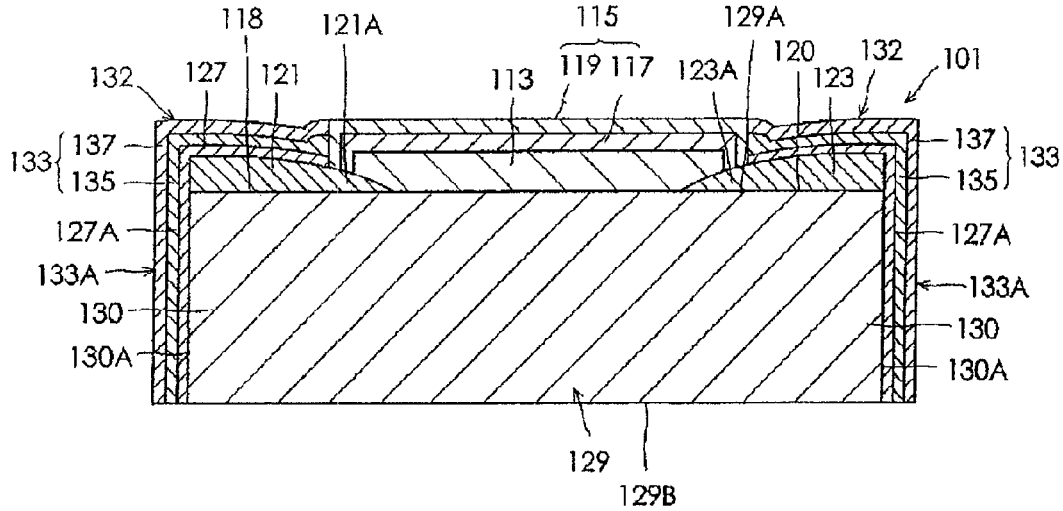
FIG. 4 is a sectional view schematically showing a structure of another embodiment of the present invention.

Reference numeral 3 in FIG. 2(A) indicates a large-sized insulating substrate formed of a ceramic substrate for forming a large number of or multiple chip resistors. By using an electrically conductive glass paste or a conductive paste based on metal glaze and by screen printing, a plurality of electrode layers 7 are formed on a front surface 5 of the large-sized insulating substrate 3 to constitute columns of electrode layers 9 and rows of electrode layers 11. The columns of electrode layers 9 are disposed at predetermined intervals in a Y or longitudinal direction shown in FIG. 2(A), while the rows of electrode layers 11 are disposed at predetermined intervals in an X or lateral direction shown in FIG. 2(A). Referring to FIG. 2(A), 4×4 electrode layers 7 are shown. Actually, however, more electrode layers 7 are formed. An Ag-Pd glass paste including silver, for example, is used as the conductive glass paste. In this embodiment, the conductive glass paste is fired at approximately 850° C. to form first and second surface electrodes 21 and 23 which will be described later. Each of the plurality of the electrode layers 7 has a lateral length larger than a longitudinal length. It is because the electrode layer 7 is later halved. As will be described more detail later, the electrode layer 7 formed by the screen printing is fired so that the electrode layer 7 assumes a shape in which the height of a central portion of the printed conductive glass paste is the highest by surface tension, a shape which is smoothly convex in a direction away from the substrate front surface 5 of the substrate 3 or a shape resembling a mountain of which the height gradually increases from the foot to the top of the mountain. When the electrode layer 7 is halved, a pair of the surface electrodes 21 and 23 are formed at both end portions 18 and 20 of a substrate surface 29A of an insulating substrate 29.

In the step of FIG. 2(B), a resistor layer 13 is formed as an electric element layer on the substrate front surface 5 of the large-sized insulating substrate 3 by printing so that the resistor layer 13 extends across the adjacent electrode layers 7 included in the columns of electrode layers 11. The resistor layer 13 is formed of a resistor glass paste mainly composed of a metal oxide such as ruthenium oxide and including glass as a binder. In this embodiment, a resistor body pattern is printed on the front surface 5 of the large-sized insulating substrate 3 by screen printing, using the resistor body glass paste. Then, the printed resistor body pattern is fired at a firing temperature of approximately 850° C., thereby forming the resistor layer 13 of a thick film.

Next, as shown in FIGS. 2(C) and 2(D), an insulating protective layer 15 is formed by printing so that the insulating protective layer 15 covers entirely the resistor layer 13 and covers partly a pair of the electrode layers 7 adjacent to the resistor layer 13. The insulating protective layer 15 is formed of a glass layer 17 and an insulating resin layer 19 that covers the glass layer 17. The insulating protective layer 15 in the chip resistor 1 in FIG. 1 covers entirely the resistor layer 13 or the electric element layer and portions 21A and 23A of a pair of the surface electrodes 21 and 23 adjacent to the resistor layer 13. The resistor layer 13 is covered with the glass layer 17, and then resistance value adjustment or trimming is performed by forming a trimming groove on the resistor layer 13 by laser light. Then, the insulating resin layer 19 is formed on the glass layer 17. With this arrangement, the resistance value of the resistor layer 13 may be prevented from varying. Both of the glass layer 17 and the insulating resin layer 19 are formed by screen printing. The glass layer 17 is fired at a firing temperature of approximately 850° C. The insulating resin layer 19 is formed by firing at a firing temperature of approximately 200° C., using a synthetic resin paste such as an epoxy-based resin or a phenol-based resin.

Figure 3:
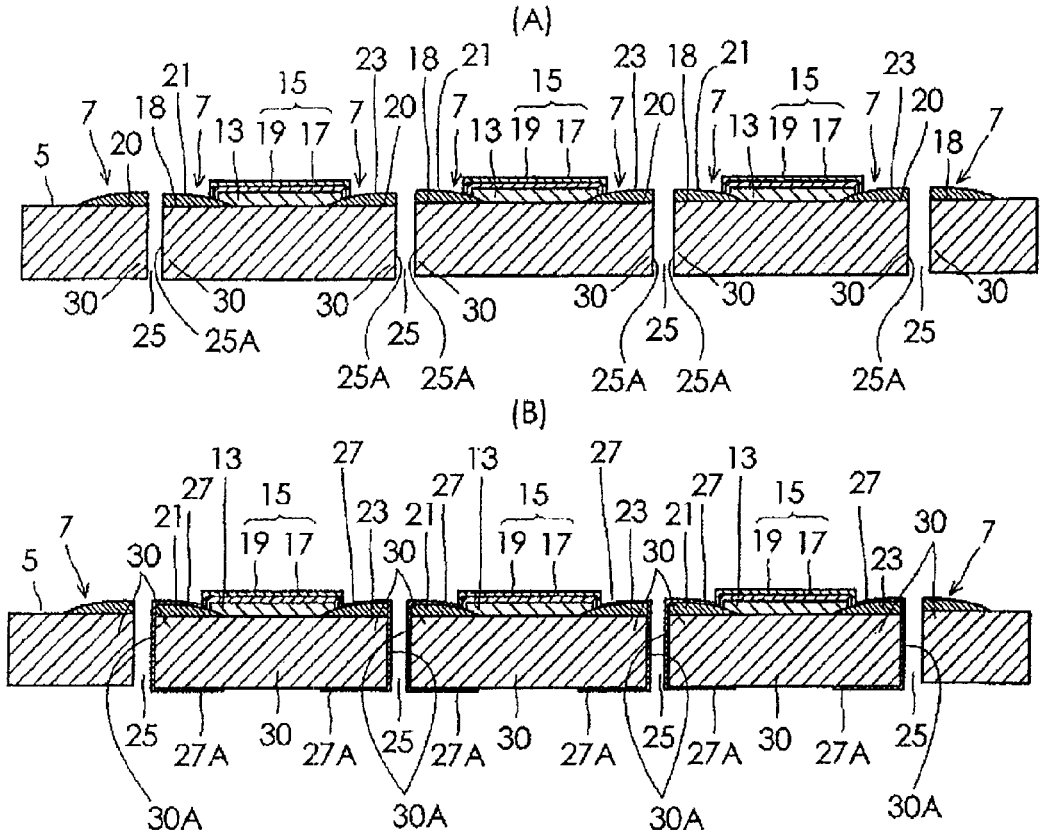
FIGS. 3(A) and 3(B) are respectively an enlarged sectional view taken along line IIIA-IIIA in FIG. 2(D) and an enlarged sectional view taken along line IIIB-IIIB in FIG. 2(E).

After the insulating protective layer 15 has been formed, a plurality of slits 25 are formed in the large-sized insulating substrate 3, as shown in FIG. 2(D) and FIG. 3(A) which is an enlarged sectional view taken along line IIIA-IIIA in FIG. 2(D) in order to halve each of the electrode layers 7 included in the columns of electrode layers 9 at a central portion of each electrode layer and then form a pair of surface electrodes 21 and 23 at both end portions of the resistor layer 13.

Next, as shown in FIG. 2(E) and FIG. 3(B) which is an enlarged sectional view taken along line IIIB-IIIB in FIG. 2(E) , a base conductive layer 27 is formed by sputtering or evaporation. The base conductive layer 27 covers portions of the pairs of the surface electrodes 21 and 23 not covered with the insulating protection layer 15, inner surfaces 25A of the slits 25 and portions of the back surface of the large-sized insulating substrate 3. In this embodiment, the base conductive layer 27 is an alloy layer including Cu, Ni, and Cr. These metals have a property allowing a plated metal to readily adhere thereto. With reference to the configuration of the chip resistor in FIG. 1 in this embodiment, the base conductive layer 27 includes extended conductive portions 27A for covering side surfaces 30A of end portions 30 of the insulating substrate 29 adjacent to the surface electrodes 21 and 23. Then, parts 27B of the extended conductive portions 27A further extend to part of a back surface 29B of the insulating substrate 29 facing the front surface 29A of the insulating substrate 29, in this embodiment. An appropriate mask should be formed on the front surface and the back surface of the large-sized insulating substrate 3 in order to form the base conductive layer 27 at desired positions.

Then, after the base conductive layer 27 has been formed as shown in FIG. 2(F), cut processing is applied to locations along cutting lines 28, using dicing. The cut processing is applied to the locations in parallel with each row of electrode layers 11, which sandwich the insulating protective layer 15 therebetween. By the cut processing using dicing, chip pieces 31 are separated from the large-sized insulating substrate 3 on the front surface 5 of the insulating substrate 29 formed of the ceramic substrate. Chip pieces 31 each include a pair of the surface electrodes 21 and 23, the resistor layer 13, and the insulating protective layer 15.

Finally, at least one plated layer 33 is formed on the base conductive layer 27 of each separated chip piece 31. The plated layer 33 is formed on the extended conductive portions 27A of the base conductive layer 27 as well. Portions of the plated layer 33 formed on the extended conductive portions 27A constitute extended plated portions 33A. In this embodiment, the plated layer 33 is configured to have a two-layer structure in which an Sn plated layer 37 is formed on a Ni plated layer 35. The Ni plated layer 35 is formed by nonelectrolytic plating. The base conductive layer 27 and the plated layer 33 thus formed constitute a thin-film conductive layer 32, as shown in FIG. 1.

The plated layer 33 is formed on the extended conductive portions 27A of the base conductive layer 27 as well, as shown in FIG. 1. The portions of the plated layer 33 formed on the extended conductive portions 27A constitute the extended plated portions 33A. Then, parts 33B of the extended plated portions 33A extend to the parts 27B of the extended conductive portions 27A that extend to the back surface 29B of the insulating substrate 29.

In the chip resistor or chip-like electric component manufactured by the manufacturing method in this embodiment, thicknesses of the pair of the surface electrodes 21 and 23 increase from the resistor layer 13 toward a pair of the end portions 30 of the insulating substrate 29 positioned in a direction in which the pair of the surface electrodes 21 and 23 are arranged. When the surface electrodes 21 and 23 of such a shape are used, a plating reservoir S is formed between the insulating protective layer 15 and the surface electrode 21 or 23. For that reason, when forming the at least one plated layer 33 which includes the plated layers 35 and 37, the plated metal pools in the plating reservoir S. The at least one plated layer 33 may work to reduce to some extent a height difference between a soldering electrode portion, which is formed of the surface electrode 21 or 23, the base conductive layer 27, and the plated layer 33, and the insulating protective layer 15. Consequently, according to this embodiment, unlike a related art, the height difference may be reduced, without providing an additional layer for reducing the height difference. The larger the number of layers of the at least one plated layer 33 is, the more the height difference is reduced.

FIG. 4 is a sectional view schematically showing a structure of a chip resistor 101 in another embodiment of the present invention. Referring to FIG. 4, reference numerals obtained by adding 100 to the reference numerals in FIG. 1 are assigned to components in this embodiment that are the same as those in FIG. 1, thereby omitting the description. In this embodiment, extended conductive portions 127A extend to side surfaces 130 of an insulating substrate 129. However, the extended conductive portion 127A does not extend to a back surface 129B. In this case as well, the present invention is applicable. The present invention is applicable even if the extended conductive portions 127A are not provided.

The insulating protective layers 15 and 115 are each formed of two layers in the above-mentioned embodiments. Of course, the insulating protective layers 15 and 115 may have a single-layer structure.

Industrial Applicability

In the present invention, each pair of surface electrodes are formed so that the thicknesses of the pair of surface electrodes increase from the electrical element layer toward the end portions of the insulating substrate positioned in the direction in which the pair of surface electrodes are arranged. Accordingly, when the surface electrodes of such a shape are employed, the plating reservoir is formed between each surface electrode and the insulating protective layer. For that reason, when forming the at least one plated layer, the plated metal pools in the plating reservoir. The at least one plated layer may work to reduce the height difference between the soldering electrode portion and the protective layer. Accordingly, the height difference maybe reduced without providing the additional layer for reducing the height difference. The larger the number of layers of the at least one plated layer is, the more the height difference is reduced.

In the manufacturing method of the present invention, a method of halving each electrode layer at the central portion of the electrode layer is adopted. Consequently, a shape may be readily formed where the pair of surface electrodes become thicker toward the end portions of the insulating substrate.

The invention claimed is:

1. A chip-like electric component comprising:

an insulating substrate made of ceramic, including a front surface and a back surface facing the front surface;

a pair of surface electrodes based on metal glaze, provided at both end portions of the front surface of the insulating substrate;

an electrical element layer electrically connected to the pair of surface electrode and formed on the front surface;

an insulating protective layer made of an electrical insulating material, the insulating protective layer covering entirely the electrical element layer and partly the pair of surface electrodes adjacent to the electrical element layer; and a thin-film conductive layer for covering at least portions of the surface electrodes that are not covered with the insulating protective layer, the thin-film conductive layer including at least one plated layer, wherein:

the pair of surface electrodes are formed so that thicknesses of the pair of surface electrodes increase from the electrical element layer toward end portions of the insulating substrate, which are positioned in a direction in which the pair of surface electrodes are arranged, so as to form a plating reservoir between the pair of surface electrodes and the insulating protective layer, the thin-film conductive layer includes a base conductive layer formed by sputtering or evaporation for covering the portions of the surface electrodes that are not covered with the insulating protective layer and the at least one plated layer formed on the base conductive layer, the base conductive layer including extended conductive portions for covering side surfaces of the end portions of the insulating substrate adjacent to the surface electrodes, and the at least one plated layer including extended plated portions for covering the extended conductive portions; and the extended conductive portions further extend to part of the back surface of the insulating substrate, and the extended plated portions further extend to cover the extended conductive portions which extend to part of the back surface.

2. A chip-like electric component comprising:

an insulating substrate made of ceramic, including a front surface and a back surface facing the front surface;

a pair of surface electrodes based on metal glaze, provided at both end portions of the front surface of the insulating substrate;

an electrical element layer electrically connected to the pair of surface electrodes and formed on the front surface;

an insulating protective layer made of an electrical insulating material, the insulating protective layer covering entirely the electrical element layer and partly the pair of surface electrodes adjacent to the electrical element layer; and a thin-film conductive layer for covering at least portions of the surface electrodes that are not covered with the insulating protective layer, the thin film conductive layer including at least one plated layer, wherein:

the pair of surface electrodes are formed so that thicknesses of the pair of surface electrodes increase from the electrical element layer toward end portions of the insulating substrate which are positioned in a direction in which the pair of surface electrodes are arranged, so as to form a plating reservoir between the pair of surface electrodes and the insulating protective layer.

3. The chip-like electric component according to claim 2, wherein the thin-film conductive layer includes a base conductive layer formed by sputtering or evaporation for covering the portions of the surface electrodes that are not covered with the insulating protective layer and the at least one plated layer formed on the base conductive layer.

4. The chip-like electric component according to claim 3, wherein the base conductive layer includes extended conductive portions for covering side surfaces of the end portions of the insulating substrate adjacent to the surface electrodes, and the at least one plated layer includes extended plated portions for covering the extended conductive portions

5. The chip-like electric component according to claim 4, wherein the extended conductive portions further extend to part of the back surface of the insulating substrate, and the extended plated portions further extend to cover the extended conductive portions which extend to part of the back surface.

6. The chip-like electric component according to claim 1, wherein the base conductive layer includes Cu, Ni, and Cr; and the at least one plated layer is of a two-layer structure in which an Sn plated layer is formed on a Ni plated layer.

7. A chip resistor comprising:

an insulating substrate made of ceramic, including a front surface and a back surface facing the front surface;

a pair of surface electrodes based on metal glaze including Ag, provided at both end portions of the front surface of the insulating substrate;

a resistor layer electrically connected to the pair of surface electrodes and formed on the front surface;

an insulating protective layer made of an electrical insulating material, the insulating protective layer covering entirely the resistor layer and partly the pair of surface electrodes adjacent to the resistor layer; and a thin-film conductive layer for covering at least portions of the pair of surface electrodes that are not covered with the insulating protective layer, the thin film conductive layer including at least one plated layer, wherein:

the pair of surface electrodes are formed so that thicknesses of the pair of surface electrodes increase from the resistor layer toward end portions of the insulating substrate which are positioned in a direction in which the pair of surface electrodes are arranged, so as to form a plating reservoir between the pair of surface electrodes and the insulating protective layer, and the thin-film conductive layer includes a base conductive layer formed by sputtering or evaporation for covering the portions of the surface electrodes that are not covered with the insulating protective layer and the at least one plated layer formed on the base conductive layer.

8. The chip resistor according to claim 7, wherein the insulating protective layer comprises a glass layer for covering the resistor layer and an insulating resin layer for covering the glass layer;

the base conductive layer includes Cu, Ni, and Cr; and the at least one plated layer is of a two-layer structure in which an Sn plated layer is formed on a Ni plated layer.

9. A manufacturing method of a chip-like electric component comprising the steps of:

forming a plurality of electrode layers on a front surface of a large-sized insulating substrate made of ceramic at predetermined intervals by screen printing, using a conductive paste based on metal glaze, to constitute columns of electrode layers and rows of electrode layers;

forming an electrical element layer on the front surface of the large sized insulating substrate by printing so that the electrical element layer extends across each pair of adjacent electrode layers included in the rows of electrode layers;

forming an insulating protective layer by printing using an electrical insulating material so that the insulating protective layer covers entirely the electrical element layer and partly the pairs of electrode layers adjacent to the electrical element layer;

forming a plurality of slits in the large-sized insulating substrate so as to halve each of the electrode layers included in the columns of electrode layers at a central portion of each electrode layer and then form a pair of surface electrodes at both end portions of the electrical element layer;

forming by sputtering or evaporation a base conductive layer for covering portions of the pair of surface electrodes that are not covered with the insulating protective layer and inner surfaces of the slits;

separating chip pieces each including an insulating substrate, the pair of surface electrodes, the electrical element layer, and the insulating protective layer after the base conductive layer has been formed; and forming at least one plated layer on the base conductive layer of each of the separated chip pieces, wherein the pair of surface electrodes are formed so that thicknesses of the pair of surface electrodes increase from the electrical element layer toward end portions of the insulating substrate, which are positioned in a direction in which the pair of surface electrodes are arranged, so as to form a plating reservoir between the pair of surface electrodes and the insulating protective layer.

10. The manufacturing method of a chip-like electric component according to claim 9, wherein:

the base conductive layer includes extended conductive portions for covering side surfaces of end portions of the insulating substrate adjacent to the surface electrodes, and the at least one plated layer includes extended plated portions for covering the extended conductive portions; and the extended conductive portions further extend to part of a back surface of the insulating substrate facing the front surface of the insulating substrate, and the extended plated portions further extend to cover the extended conductive portions which extend to part of the back surface.

11. The chip-like electric component according to claim 3, wherein the base conductive layer includes Cu, Ni, and Cr; and the at least one plated layer is of a two-layer structure in which an Sn plated layer is formed on a Ni plated layer.

12. The chip-like electric component according to claim 4, wherein the base conductive layer includes Cu, Ni, and Cr; and the at least one plated layer is of a two-layer structure in which an Sn plated layer is formed on a Ni plated layer.

13. The chip-like electric component according to claim 5, wherein the base conductive layer includes Cu, Ni, and Cr; and the at least one plated layer is of a two-layer structure in which an Sn plated layer is formed on a Ni plated layer.

* * * * *